United States Patent [19]

Faure

[11] 4,035,924

[45] July 19, 1977

[54] FREEZE-DRYING OF SOLID, LIQUID OR PASTE-LIKE PRODUCTS

[75] Inventor: Jean-Christian Faure, Rumilly, France

[73] Assignee: Societe d'Assistance Technique pour Produits Nestle S.A., Lausanne, Switzerland

[21] Appl. No.: 608,054

[22] Filed: Aug. 27, 1975

[30] Foreign Application Priority Data

Sept. 11, 1974 France ..... 74.30745

[51] Int. Cl.[2] ..... F26B 5/06; F26B 13/30

[52] U.S. Cl. ..... 34/5; 34/92

[58] Field of Search ..... 34/5, 92; 53/39, 375

[56] References Cited

U.S. PATENT DOCUMENTS

| | | | |
|---|---|---|---|
| 649,012 | 5/1900 | Tapscott | 34/92 X |
| 3,264,746 | 8/1966 | Pearce | 34/5 |
| 3,286,365 | 11/1966 | Hackenberg | 34/5 |
| 3,286,366 | 11/1966 | Seligman | 34/92 |
| 3,359,746 | 12/1967 | Razum et al. | 34/5 |
| 3,449,885 | 6/1969 | Starkey, Jr. | 34/5 X |
| 3,491,509 | 1/1970 | Wright | 53/39 |

*Primary Examiner*—John J. Camby
*Attorney, Agent, or Firm*—Watson, Leavenworth,Kelton & Taggart

[57] ABSTRACT

In the lyophilization of solid, liquid or pasty products the product to be lyophilized is placed in an open secondary container of flexible material which is capable of being subsequently closed and lyophilized in a lyophilization apparatus with the container kept open. On completion of lyophilization the container is closed and the closed container withdrawn from the apparatus. Preferably the container is in the form of a bag, e.g. a heat-sealable plastic bag. A lyophilization apparatus is provided with means for supporting secondary containers accommodating product to be lyophilized, means for keeping the secondary containers open during lyophilization and means for closing the containers on completion of lyophilization.

9 Claims, 3 Drawing Figures

FREEZE-DRYING OF SOLID, LIQUID OR PASTE-LIKE PRODUCTS

This invention relates to the lyophilisation of solid, liquid or pasty products.

In the majority of conventional lyophilisation processes, recovery of the lyophilised product is a delicate operation, especially when this product is sensitive to air, light or any other ambient medium capable of polluting, contaminating or even degrading it.

The present invention provides a convenient process which enables the product of lyophilisation to be protected against any attack coming from the outside or from the ambient medium, irrespective of whether the product is present in bulk or in the form of unit doses.

The present invention relates to a process for the lyophilisation of a solid, liquid or pasty product, which comprises placing the product to be lyophilised in an open container of flexible material capable of being subsequently closed (a so-called secondary container), introducing the container thus filler into a lyophilisation apparatus, lyophilising the product with the container kept open, closing the container on completion of lyophilisation and finally, withdrawing the container from the lyophilisation apparatus.

According to preferred aspects of the invention:

- the secondary container accommodating the product to be lyophilised consists of a flexible material and is preferably in the form of a bag;
- the nature of the walls of the container is selected in dependence upon the type of barrier effect and fluid-tightness required, and subsequent closure on completion of the lyophilisation process is carried out by mechanical, thermal or any other means compatible with the nature of the walls;
- in one particular embodiment, the container is a bag made of a heat-sealable plastics material;
- the constituent material of the container or bag is transparent, translucent or opaque.

The invention also relates to a lyophilisation apparatus for carrying out the process described above, comprising an evacuable chamber provided with evaporation means, which chamber is further provided with means for supporting secondary containers accommodating product to be lyophilised, means for keeping the containers open during lyophilisation and means for closing the containers on completion of lyophilisation.

Figure 1:
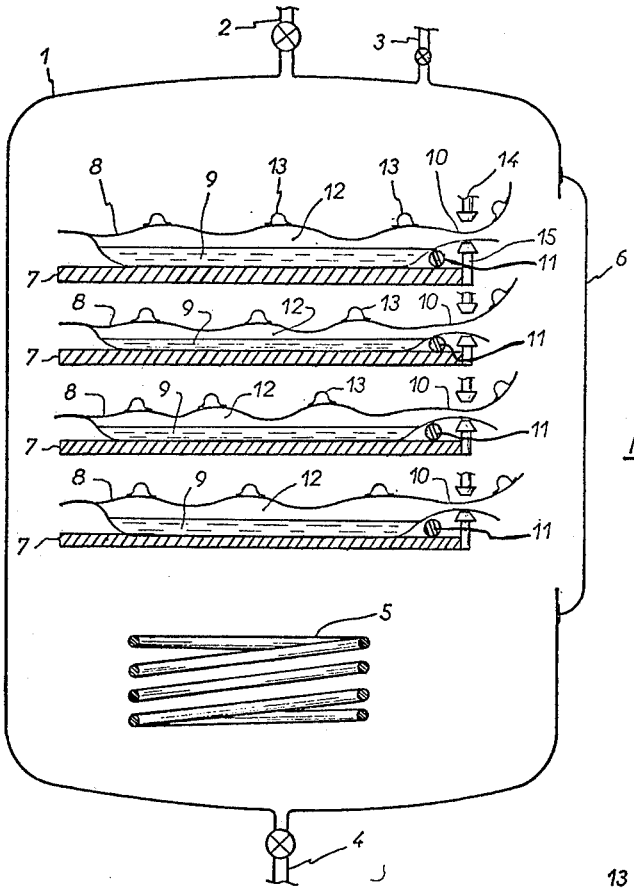

Other features and advantages of the invention will become more clearly apparent from the following description in conjunction with the accompanying drawings, wherein:

FIG. 1 diagrammatically illustrates a lyophilisation apparatus in the course of operation and carrying out the process according to the invention.

Figure 2:
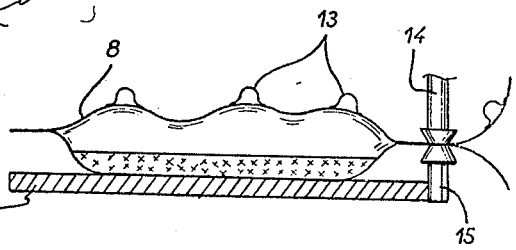

FIG. 2 is a diagrammatic view illustrating the closure of a container accommodating the lyophilised product before it is removed from the lyophilisation apparatus.

Figure 3:
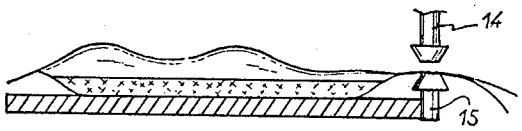

FIG. 3 diagrammatically illustrates the final stage of the operation after closure of the container and before its removal from the lyophilisation apparatus.

Referring to the drawings, FIG. 1 diagrammatically illustrates a lyophilisation apparatus 1 with the usual fittings, namely: a pipe 2 connected to a vacuum source (not shown); a pipe 3 for the introduction of a neutral or inert gas; a discharge pipe 4; an evaporator coil 5 and a loading door 6. The lyophilisation apparatus additionally comprises a series of plates or supporting brackets 7. According to the invention, these supporting means 7 are each intended to receive one or more secondary containers which are themselves filled with the product to be lyophilised.

In the embodiment of the invention illustrated in the accompanying drawings, the secondary container(s), such as 8, are in the form of flexible bags disposed on the supports 7. These bags are filled with the product to be lyophilised 9 (solid, liquid or pasty) which, in the embodiment illustrated, is a liquid. In order to prevent this liquid from flowing out through the opening 10 in view of the horizontal position of the bag, a boss 11, a shoulder or some other form of projection is provided on each of the supports 7 opposite the openings 10 in order to raise the lower wall of the bag resting on its support.

During the normal operation of the lyophilisation apparatus, the upper walls of each bag 8 are kept permanently apart from the lower walls so as to form an adequate empty space 12 above the product to be lyophilised. This result may be achieved by gripping means 13 of any suitable type, such as clips supported by linkages (not shown), suction cups similarly supported by any suitable means (not shown) etc. In this way, the product to be lyophilised, accommodated in its container, is in direct contact with the atmosphere prevailing in the lyophilisation apparatus and is directly subjected to the conditions which have been established therein in the same way as if this product had been directly introduced into the apparatus, as is normally the case with conventional lyophilisation apparatus.

For carrying out the process according to the invention, the lyophilisation apparatus 1 also comprises conventional means for closing each of the secondary containers 8. In the particular case illustrated in the drawings, these closure means are in the form of two jaws 14 and 15 which, in the case of plastics containers, form the heat-sealing means for the plastic material. The means 14 and 15 may of course be mechanical or similar means specifically designed to obtain the required closure depending upon the constituent material of the container.

The jaws 14 and 15 are shown in their working position in FIG. 2. This Figure shows only one of the supporting plates, such as 7, with its container 8. FIG. 3 shows the same container 8 with its opening closed (the jaws 14 and 15 then being in the rest position). The gripping means 13 no longer act on the upper wall of this container which is thus capable of being removed from the lyophilisation apparatus.

It will be noted that this procedure, although allowing lyophilisation to be carried out in the usual way, has the advantage of enabling the lyophilised product to be removed from the lyophilisation apparatus free of any contamination by the ambient medium with which it may come into contact on leaving the apparatus.

It is obvious that, although the drawings show the containers in a horizontal position, the containers could equally well be disposed in a vertical position, in which case the gripping means would be arranged laterally and at the periphery of the walls of the containers, whilst the closure means would be situated opposite the opening of each container, their role and their function being strictly identical with the role and function which have been described in the case of the particular example selected. In addition, the nature and the physicochemical characteristics of the walls of the secondary containers may readily be determined by the expert according to the required result.

These walls will be air-tight, gas-tight or moisture-proof, according to the protection required.

They may be transparent, translucent or opaque, according to the required protection against radiation.

It is also obvious that the present invention has only been described purely by way of illustration, and that any useful modification of detail (with regard to the choice of equivalent means) may be made to it without departing from its scope as defined in the following claims.

I claim:

1. A process for the lyophilisation of solid, liquid and paste-like products, which comprises the steps of:

providing an elongated container of flexible material having opposed container walls and a closeable opening at one end thereof;

introducing the container into a lyophilisation apparatus;

placing the product to be lyophilised in said container;

lyophilising said product in said apparatus while holding the container walls appart thereby to maintain said container open;

on completion of lyophilisation closing the said opening in said container; and withdrawing said closed container from said apparatus.

2. A process according to claim 1, in which said container is in the form of a bag.

3. A process according to claim 1, in which said container made of a fluid-tight material and is closeable by mechanical means.

4. A process according to claim 1, in which said container is made of a fluid-tight material and is closeable by thermal means.

5. A process according to claim 4, in which said container is a bag of a heat-sealable plastics material.

6. A process according to claim 5, in which said container is made of a transparent material.

7. A process according to claim 5, in which said container is made of a material which is translucent or opaque to provide protection against radiation.

8. A lyophilisation apparatus comprising an evacuable chamber provided with evaporation means, said chamber being further provided with means for supporting containers accommodating product to be lyophilised, means for keeping said containers open during lyophilisation and means for closing said containers on completion of lyophilisation.

9. A process for the lyophilisation of solid, liquid and paste-like products, which comprises the steps of:

providing an elongated container of flexible material having opposed container walls and a closeable opening at one end thereof;

placing the product to be lyophilised in said container;

introducing said product containing container into a lyophilisation apparatus;

lyophilising said product in said apparatus while holding the container walls apart thereby to maintain said container open;

on completion of lyophilisation closing the said opening in said container; and withdrawing said closed container from said apparatus.

* * * * *